US011753829B2

(12) United States Patent
Charette

(10) Patent No.: US 11,753,829 B2
(45) Date of Patent: Sep. 12, 2023

(54) TELESCOPIC STAIRCASE SYSTEM AND USES THEREOF

(71) Applicant: Davibois inc., Windsor (CA)

(72) Inventor: David Charette, Sherbrooke (CA)

(73) Assignee: METALTECH-OMEGA INC., Laval (CA)

( * ) Notice: Subject to any disclaimer, the term of this patent is extended or adjusted under 35 U.S.C. 154(b) by 37 days.

(21) Appl. No.: 17/044,180

(22) PCT Filed: Jun. 12, 2019

(86) PCT No.: PCT/CA2019/050832

§ 371 (c)(1),
(2) Date: Sep. 30, 2020

(87) PCT Pub. No.: WO2019/237199

PCT Pub. Date: Dec. 19, 2019

(65) Prior Publication Data

US 2021/0087821 A1 Mar. 25, 2021

Related U.S. Application Data

(60) Provisional application No. 62/683,799, filed on Jun. 12, 2018.

(51) Int. Cl.
*E04F 11/18* (2006.01)
*E04F 11/025* (2006.01)
(Continued)

(52) U.S. Cl.
CPC ..... *E04F 11/068* (2013.01); *E04F 11/112* (2013.01); *E04F 11/1863* (2013.01); *E04F 11/025* (2013.01); *E04F 2011/0209* (2013.01)

(58) Field of Classification Search
CPC ..... E04F 2011/187; E04F 2011/1889; E04F 2011/005; E04F 2011/0203; E04F 2011/0205; E04F 2011/0209
See application file for complete search history.

(56) References Cited

U.S. PATENT DOCUMENTS 387,147 A 7/1888 Colley
2,835,475 A * 5/1958 Enghauser ..... E04F 11/181 256/22

(Continued)

FOREIGN PATENT DOCUMENTS

| | | | |
|---|---|---|---|
| CA | 3033023 | A1 | 2/2016 |
| CN | 106522817 | A | 3/2022 |
| DE | 3318400 | A1 | 11/1984 |

*Primary Examiner* — Jessica L Laux
(74) *Attorney, Agent, or Firm* — BENOIT & CÔTÉ INC.; France Côté

(57) ABSTRACT

The invention relates to a telescopic staircase to be installed on construction sites for providing a safe staircase for workers during building construction. The telescopic staircase comprising at least one lateral guard comprising a top rail, a bottom rail and at least two newels, the bottom rail having a plurality of connecting holes, and a plurality of tread assembly comprising a tread plate, at least two stringer portions and at least two pairs of support members, each support member having at least one connecting hole, in which the at least one lateral guard includes a first portion being retractable into and extensible from a second portion, in which each support member substantially forms a 45° angle with the tread plate, and in which the support members are to be attached to the top surface of the bottom rail via attachment means through the connecting holes.

9 Claims, 5 Drawing Sheets

(51) Int. Cl.

| | |
|---|---|
| ***E04F 11/06*** | (2006.01) |
| ***E04F 11/112*** | (2006.01) |
| *E04F 11/02* | (2006.01) |

(56) References Cited

U.S. PATENT DOCUMENTS

| | | | | | |
|---|---|---|---|---|---|
| 3,871,479 | A * | 3/1975 | Pelto | A62B 5/00 | 182/86 |
| 4,030,255 | A * | 6/1977 | Hartman | E04H 3/123 | 52/9 |
| 4,468,901 | A * | 9/1984 | Henderson | E04F 11/025 | 52/79.6 |
| 4,571,895 | A * | 2/1986 | Lyman, Jr. | E04H 3/123 | 52/9 |
| 4,583,334 | A * | 4/1986 | Hubbard | E04F 11/112 | 52/182 |
| 5,349,795 | A | 9/1994 | French | | |
| 8,316,595 | B2 | 11/2012 | Burford et al. | | |
| 8,776,947 | B1 * | 7/2014 | Wurth | E06C 7/48 | 182/1 |
| 9,380,760 | B2 * | 7/2016 | Rorke | A01K 1/035 | |
| 2013/0239496 | A1 | 9/2013 | Walston | | |

* cited by examiner

FIG. 2A
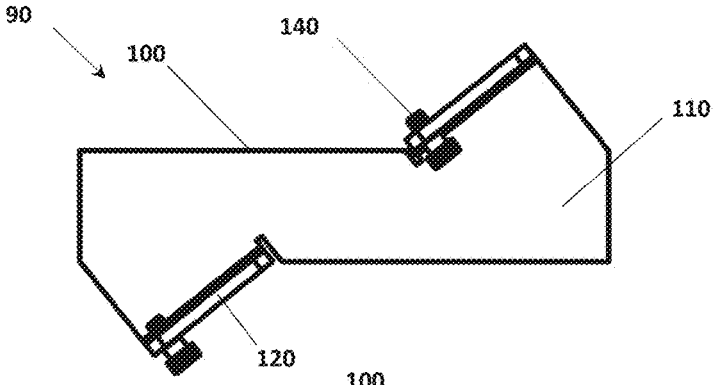
FIG 2B
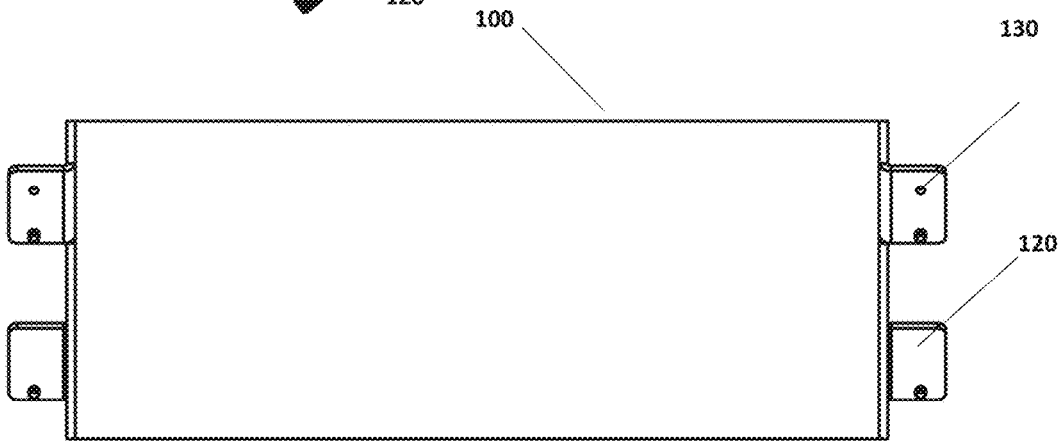
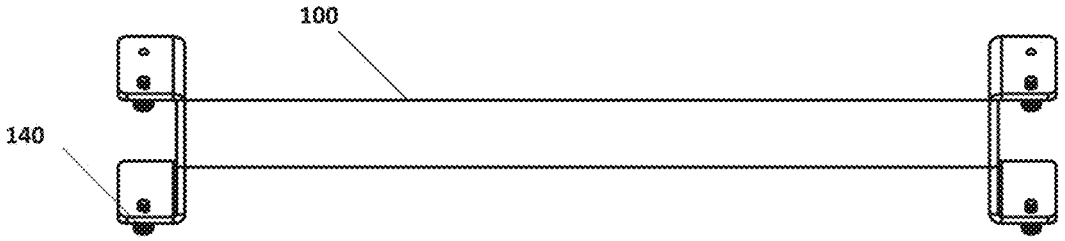
FIG. 2C

FIG. 4A
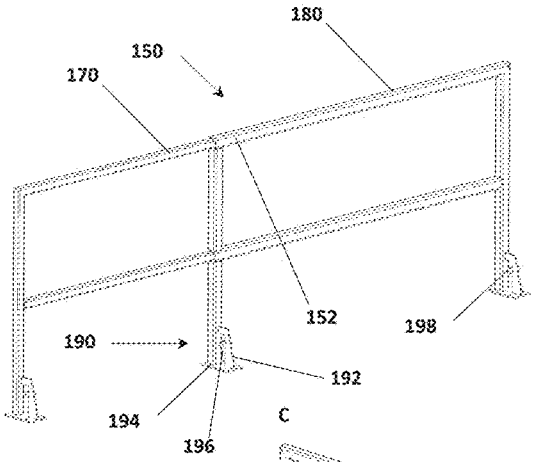
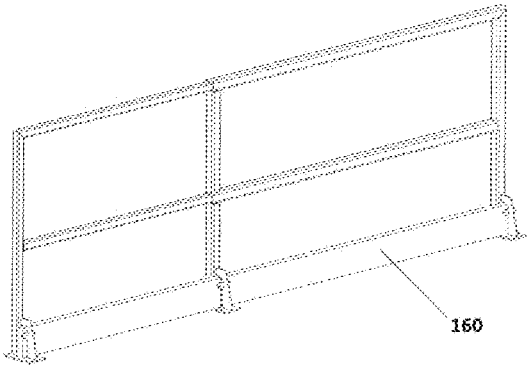
FIG. 4B
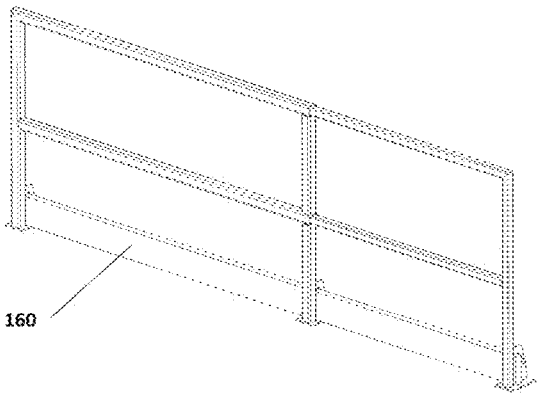
FIG. 4C

TELESCOPIC STAIRCASE SYSTEM AND USES THEREOF

BACKGROUND

(a) Field

The subject matter disclosed generally relates to a telescopic staircase system and uses thereof.

(b) Related Prior Art

Staircases typically include a staircase rail system for safety. In the staircase rail system, a row of vertical posts is conventionally topped by a hand rail along the edge of the staircase. These posts, commonly termed balusters, are supported by relatively larger posts known as newels. Thus, staircase construction requires a great deal of skill and care and can be a long process. Therefore, installing any type of staircase can require a temporary access in order to reach other levels of a building.

Extension ladders have been commonly used for many years to reach greater heights such as the roof of a house. Common extension ladders are generally only divided into two or three extendable pieces. Thus, the common extension ladder is difficult to transport and require a greater amount of space in storage and/or during transport than is desirable. Another major disadvantage is that the climbing motion of the user is unsafe, which causes thousands of injuries and many deaths each year that result from people falling off ladders.

The majority of these injuries and deaths could be avoided if the person was using a staircase instead of a ladder due to the more ergonomic climbing motion involved in using a staircase. One of the major reasons why staircases are safer than ladders includes the fact that stairs generally provide a smaller rise over run than ladders. This feature helps to prevent a user from falling backwards, which is how most injuries occur. However, staircases are not able to be transported to various locations quickly like an extension ladder.

U.S. Pat. No. 8,316,595 describes a collapsible staircase that is operable to be collapsed into a compact position for storage and transportation. Patent '595 describes a collapsible staircase having a plurality of tread plates disposed along the staircase at a substantially fixed angle and that are operable to collapse independently of each other. However, Patent '595 does not describe a staircase that is fully adjustable in height and width as needed by the user at a desired location, while preserving an equal distance between the stairs of the staircase for improved safety.

Therefore, there is a need to provide a safe and fully adjustable staircase system that is operable for easy storage, transportation and installation at a desired location.

SUMMARY

According to an embodiment, there is provided a telescopic staircase comprising, at least one lateral guard comprising a top rail, a bottom rail and at least two newels, the bottom rail having a plurality of connecting holes, and a plurality of tread assembly comprising a tread plate, at least two stringer portions and at least two pairs of support members, each support member having at least one connecting hole, in which the at least one lateral guard includes a first portion being retractable into and extensible from a second portion, in which each support member substantially forms a 45° angle with the tread plate, and in which the support members are to be attached to the top surface of the bottom rail via attachment means through the connecting holes.

The lateral guard may be high or low.

The tread assembly may be telescopic.

The telescopic staircase may be made of aluminum, magnesium, steel, stainless steel, galvanized steel, titanium, copper, brass and bronze.

According to another embodiment, there is provided a telescopic top guard comprising a top rail, a mid-rail, and at least two poles, in which the telescopic top guard includes a first portion being retractable into and extensible from a second portion, in which each of the poles includes an attachment member at the lower end of the pole, and in which the attachment member includes a retaining element and a planar element forming an aperture to receive a retainer.

According to another embodiment, there is provided a load-lifting system comprising an attachment member, a platform portion and means for mobility, in which the load-lifting system is to be coupled with the telescopic staircase and/or the telescopic top guard.

The attachment member may be coupled with at least one lateral guard.

The platform portion may be substantially parallel to the tread assemblies.

The means for mobility may comprise a powered mechanism or a manual mechanism.

According to another embodiment, there is provided a kit comprising the telescopic staircase, the telescopic top guard and the load lifting system.

The following terms are defined below.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Also, use of the "a" or "an" are employed to describe elements and components of the invention. This is done merely for convenience and to give a general sense of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. However, the following definitions refer to the particular embodiments described herein and are not to be taken as limiting; the invention includes equivalents for other undescribed embodiments. In addition, the materials, methods, and examples are illustrative only and not intended to be limiting.

The term "telescopic" is intended to mean a feature of a structure having at least two portions which can extend and/or retract relative to each other along a longitudinal axis of the arm.

The term "staircase" is intended to mean a structure containing at least one tread assembly.

The term "tread assembly" is intended to mean a step or stair in a unitary structure. The present invention is particularly adapted for, and the illustrations are related to, a plurality of tread assembly forming a straight staircase between two adjoining floors. However, it may be utilized in the formation of stairways having landings.

The term "guard" is intended to mean any structure having suitable mass and/or anchoring and a shape such that it cannot be moved by a reasonable strong individual person.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which:

FIG. 2A illustrates a side view of a single tread of a telescopic staircase, according to one embodiment of the present invention;

FIG. 2B illustrates a top view of a single tread of a telescopic staircase, according to one embodiment of the present invention;

FIG. 2C illustrates a front view of a single tread of a telescopic staircase, according to one embodiment of the present invention;

FIG. 4A illustrates a perspective view of one side of a telescopic top guard, according to one embodiment of the present invention;

FIG. 4B illustrates a perspective view of one side of a telescopic top guard assembled with a blocker, according to one embodiment of the present invention;

FIG. 4C illustrates a perspective view of another side of a telescopic top guard assembled with a blocker, according to one embodiment of the present invention;

It will be noted that throughout the appended drawings, like features are identified by like reference numerals.

DETAILED DESCRIPTION

In embodiments there are disclosed a telescopic staircase system and uses thereof.

Figure 1A:
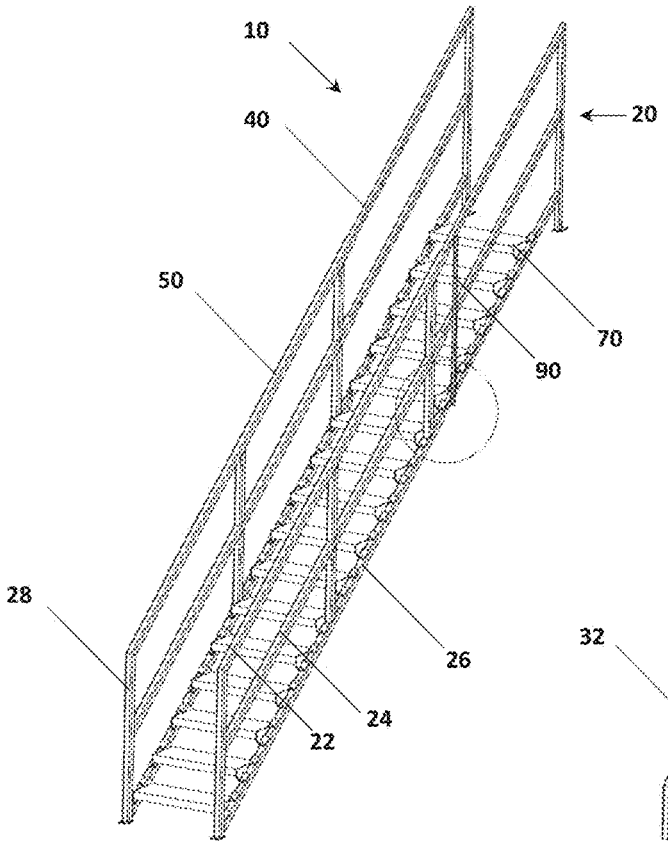
FIG. 1A illustrates a perspective view of a fully extended telescopic staircase with a high lateral guard, according to one embodiment of the present invention.
Figure 1B:
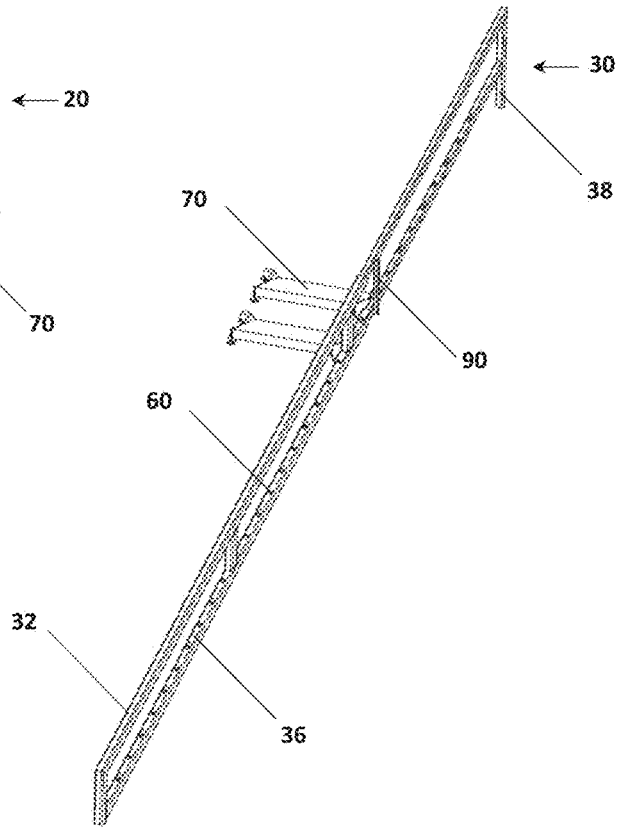
FIG. 1B illustrates a perspective view of a portion of a fully extended telescopic staircase with a low lateral guard, according to one embodiment of the present invention.
Figure 1C:
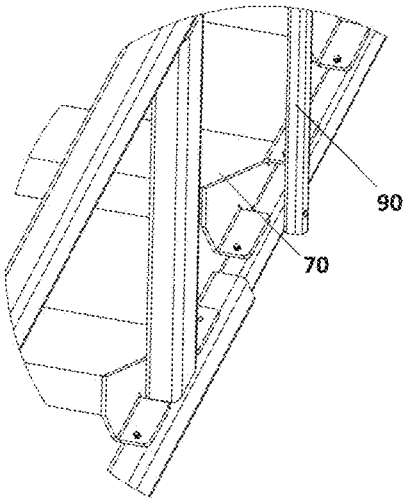
FIG. 1C illustrates a perspective view of a zoom in on a fully extended telescopic staircase with a high lateral guard, according to one embodiment of the present invention.

Referring now to the drawings, and more particularly to FIGS. 1A-C, there is shown an embodiment of a fully extended telescopic staircase (10) assembled with at least one high lateral guard (20) or at least one low lateral guard (30). The telescopic staircase (10) is incrementally adjustable to any number of different heights. The high lateral guard (20) includes a top rail (22), a mid-rail (24), a bottom rail (26) and at least two newels (28). The low lateral guard (30) includes a top rail (32), a bottom rail (36) and at least two newels (38). A first portion (40) of the high or low lateral guard (20, 30) is retractable into—and extensible from—a second portion (50) of the high or low lateral guard (20, 30), conferring the telescopic property to the staircase. The size of the structure of the first portion (40) of the high or low lateral guard (20, 30) is smaller than the structure of the second portion (50) of the high or low lateral guard (20, 30). The bottom rail (26, 36) includes a plurality of connecting holes (60) which are evenly distributed on the bottom rail (26, 36). The telescopic staircase (10) includes a plurality of reversibly connected tread assemblies (70). Each tread assembly (70) of the telescopic staircase (10) are reversibly connected to a top surface (80) of the bottom rail (26, 36). A blocker (90) is reversibly connected to the top (22, 32) and bottom (26, 36) rails of the first portion (40) of the high or low lateral guard (20, 30). The blocker (90) serves to support and lock the telescopic staircase into a determined height.

Now referring to FIGS. 2A-C, there is shown an embodiment of a single tread assembly (70). Each tread assembly (70) includes a tread plate (100), at least two stringer portions (110) and at least two pairs of support members (120). The support members (120) extend laterally and substantially perpendicularly from the stringer portion (110) of the tread assembly (70). Each pair of support members (120) comprises support members that are facing each other, where each support member is positioned on opposite stringer portions (110). Each support member has at least one connecting hole (130) and substantially forms a 45° angle with the tread plate (100). The support members (120) of the tread assembly (70) are to be connected to the top surface (80) of the bottom rail (26, 36) via attachment means (140) through the connecting holes (60, 130). The attachment means (140) includes shoulder screws.

Figure 3:
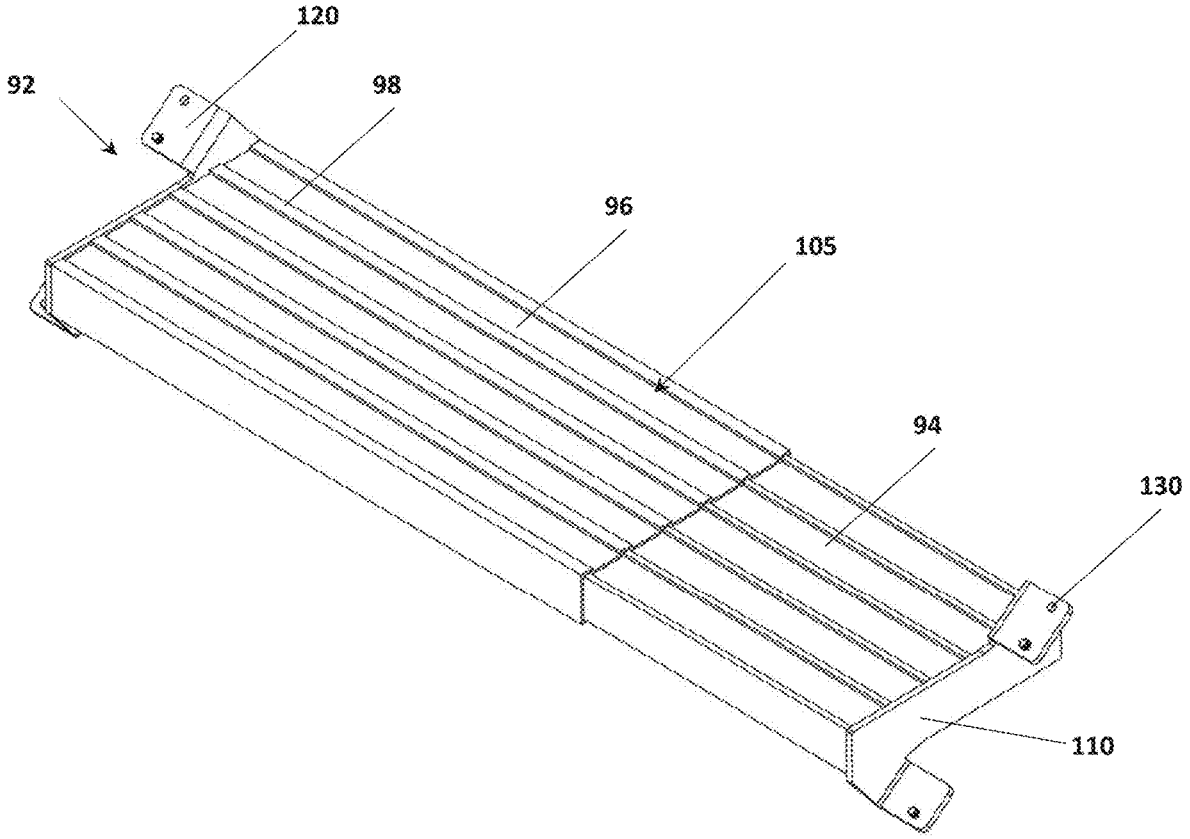
FIG. 3 illustrates a perspective view of a single telescopic tread assembly, according to one embodiment of the present invention.

Now referring to FIG. 3, there is shown an embodiment of a single telescopic tread assembly (92). Each telescopic tread assembly (92) includes a tread plate (105), at least two stringer portions (110) and at least two pairs of support members (120). Each telescopic tread assembly (92) is incrementally adjustable to any number of different lengths. A first portion (94) of the telescopic tread assembly (92) is retractable into—and extensible from—a second portion (96) of the telescopic tread assembly (92), conferring the telescopic property to the tread assembly. The size of the structure of the first portion (94) of the telescopic tread assembly (92) is smaller than the structure of the second portion (96) of the telescopic tread assembly (92). The tread plate (105) of the telescopic tread assembly (92) comprises a plurality of grooves (98) which extend on both the first portion (94) and the second portion (96) of the telescopic tread assembly (92). The support members (120) extend laterally and substantially perpendicularly from the stringer portion (110) of the telescopic tread assembly (92). Each pair of support members (120) comprises support members that are facing each other, where each support member is positioned on opposite stringer portions (110). Each support member has at least one connecting hole (130) and substantially forms a 45° angle with the telescopic tread plate (105). The support members (120) of the telescopic tread assembly (105) are to be connected to the top surface (80) of the bottom rail (26, 36) via attachment means (140) through the connecting holes (60, 130). The attachment means (140) includes shoulder screws.

Now referring to FIG. 4A-C, there is shown an embodiment of a fully extended telescopic top guard (150) assembled with or without a retainer (160). The telescopic top guard (150) is incrementally adjustable to any number of different lengths. The telescopic top guard includes a top rail (152), a mid-rail (154), and at least two poles (156). A first portion (170) of the telescopic top guard (150) is retractable into—and extensible from—a second portion (180) of the telescopic top guard, conferring the telescopic property to the top guard. The size of the structure of the first portion (170) of the telescopic top guard (150) is smaller than the structure of the second portion (180) of the telescopic top guard. Each of the poles (156) includes an attachment member (190) at the lower end (i.e. facing the ground) of the pole. The attachment member (190) includes a retaining element (192) and a planar element (194), forming an aperture (196) to receive the retainer (160). The retaining element (192) includes at least one connecting hole (198) through which attachment means (200) hold the retainer (160) in place. The retainer can be a construction wood piece. The planar element (194) includes at least one anchoring hole (210) through which attachment means hold the telescopic top guard (150) on the ground. The telescopic top guard can be installed at the top of a hole, where the telescopic staircase is to be installed.

Figure 5:
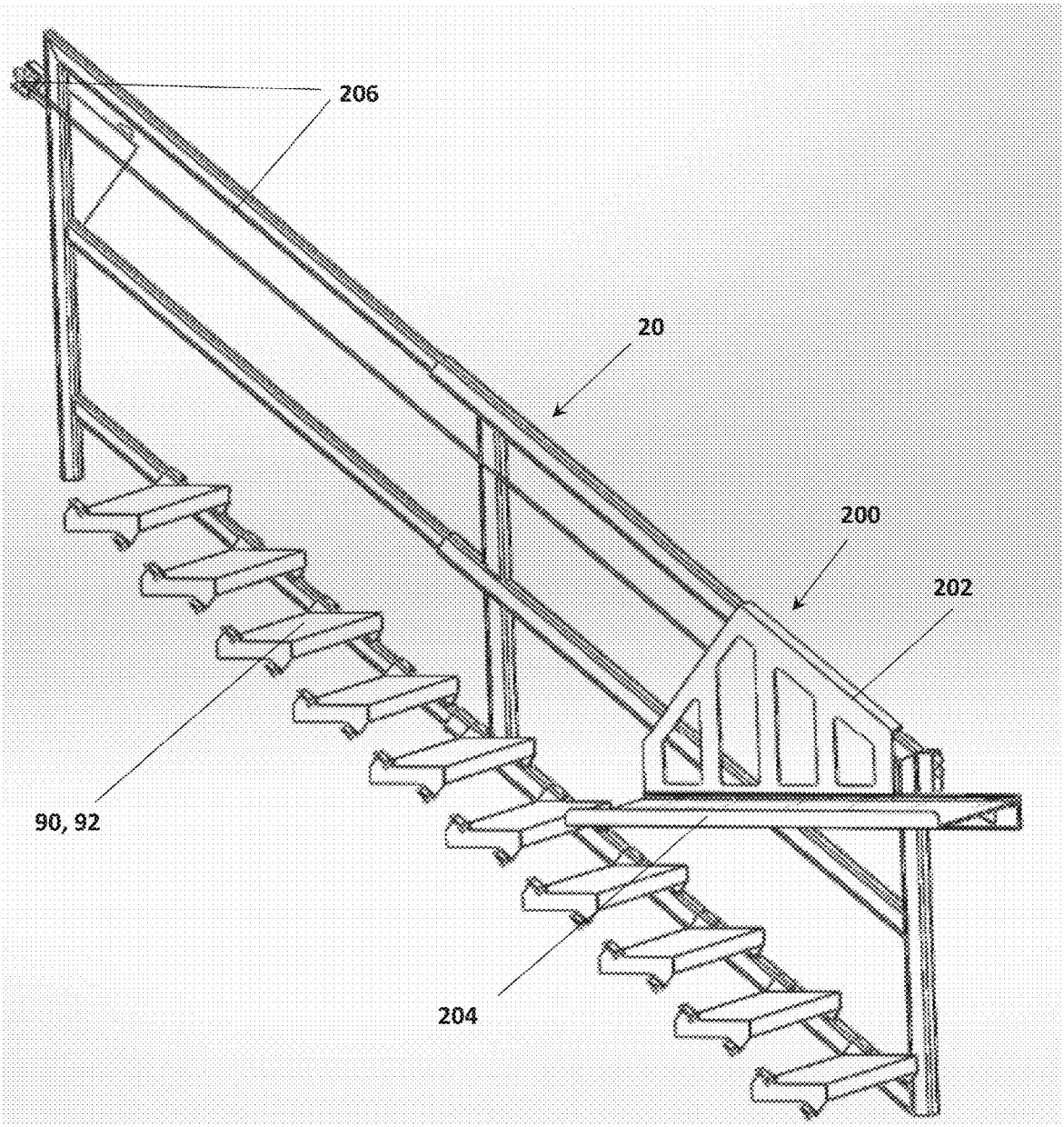
FIG. 5 illustrates a perspective view of a load-lifting system assembled on a high lateral guard, according to one embodiment of the present invention.

Now referring to FIG. 5, there is shown an embodiment of a load-lifting system (200) assembled on a high lateral guard (20). The load-lifting system comprises an attachment member (202), a platform portion (204) and means for mobility (206). The attachment member (202) is movable on the high lateral guard (20). The platform portion (204) is substantially parallel to the tread assemblies (90, 92) and can be upwardly foldable towards the attachment member (202). The means for mobility (206) can be a powered mechanism or a manual mechanism that is installed on the high lateral guard (20) of the telescopic staircase (10).

The telescopic staircase can be used with the telescopic top guard and a load lifting system as a kit, for example, for on-site temporary installation such as construction purposes. The telescopic staircase can be adjusted as needed to any height and width (when using a telescopic tread assembly). Similarly, the telescopic top guard can be adjusted as needed to any length. For instance, the tread assemblies can be reversibly connected to the bottom rail of a lateral guard on one side and being juxtaposed on the wall on the other side, without necessarily installing a lateral guard on both sides.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A telescopic staircase comprising:

a lateral guard having:

a first portion having a first top rail, a first bottom rail and a first newel, the first newel connecting the first top rail to the first bottom rail; and a second portion having a second top rail, a second bottom rail and a second newel, the second newel connecting the second top rail to the second bottom rail, wherein the first bottom rail and the second bottom rail comprise connecting holes, and wherein the first portion is telescopable inside the second portion, the first top rail is telescopable inside the second top rail and the first bottom rail is telescopable inside the second bottom rail, the first bottom rail having a first cross-section smaller than a second cross-section of the second bottom rail; and a plurality of tread assemblies, each tread assembly comprising a tread plate, each tread assembly being removably and directly attached to one of the first bottom rail or the second bottom rail, each tread assembly further comprising two stringer portions and a pair of support members on each stringer portion, each tread assembly being attached to one of the first bottom rail and the second bottom rail through the connecting holes.

2. The telescopic staircase of claim 1, wherein the lateral guard is high or low.

3. The telescopic staircase of claim 1, wherein the tread assembly is telescopic.

4. The telescopic staircase of claim 1, wherein the telescopic staircase is made of one of aluminum, magnesium, steel, stainless steel, galvanized steel, titanium, copper, brass or bronze.

5. The telescoping staircase of claim 1, wherein each support member substantially forms a 45° angle with its associated tread plate.

6. The telescoping staircase of claim 5 wherein the support members are reversibly attached to a top surface of one of the first bottom rail or the second bottom rail via attachment means through the connecting holes.

7. The telescoping staircase of claim 1 comprising two lateral guards, each tread of the plurality of treads being connected on each side to one of the two lateral guards.

8. The telescoping staircase of claim 1 further comprising a blocker connecting the first top rail to the first bottom rail so as to lock the lateral guard.

9. The telescoping staircase of claim 1 wherein the first top rail and the second top rail are telescopic along a top longitudinal axis and wherein the first bottom rail and the second bottom rail are telescopic along a bottom longitudinal axis, the top longitudinal axis and the bottom longitudinal axis being parallel to each other.

* * * * *